United States Patent [19]

Medrano

[11] Patent Number: 4,571,853

[45] Date of Patent: Feb. 25, 1986

[54] SHOE INSERT

[76] Inventor: Walter A. Medrano, Rte. 2, Box 3146, Norwood, N.C. 28128

[21] Appl. No.: 616,856

[22] Filed: Jun. 4, 1984

[51] Int. Cl.[4] ..... A43B 13/40

[52] U.S. Cl. ..... 36/43; 36/29; 36/44

[58] Field of Search ..... 36/43, 44, 29, 3 B, 36/7.5, 11.5, 3 R

[56] References Cited

U.S. PATENT DOCUMENTS

| | | | |
|---|---|---|---|
| 2,300,681 | 11/1942 | Margolin | 36/43 |
| 2,411,479 | 11/1946 | Tarlow | 36/43 |
| 2,917,844 | 12/1959 | Scholl | 36/44 |
| 3,105,985 | 10/1963 | Reid et al. | 36/11.5 |
| 3,256,621 | 6/1966 | Linton | 36/3 R |
| 3,693,269 | 9/1972 | Guarrera | 36/15 |
| 3,785,069 | 1/1974 | Brown | 36/3 B |
| 3,903,620 | 9/1975 | Gillet | 36/7.5 |
| 4,336,661 | 6/1982 | Medrano | 36/44 |

FOREIGN PATENT DOCUMENTS

| | | | |
|---|---|---|---|
| 585509 | 11/1958 | Italy | 36/3 B |

*Primary Examiner*—Werner H. Schroeder
*Assistant Examiner*—Mary A. Ellis
*Attorney, Agent, or Firm*—B. B. Olive

[57] ABSTRACT

A shoe insert in the form of an envelope which is air impervious and having a pad of cushionable material positioned in the space defined within the envelope. The envelope is provided with a predetermined number of holes of predetermined diameter through the top surface thereof to provide controlled egress and ingress of air from and to the envelope as the wearer walks thereon and thereby providing unusual shock absorption and ventilation properties to the insert.

2 Claims, 3 Drawing Figures

SHOE INSERT

DESCRIPTION

1. Technical Field

This invention relates to an insert to be worn inside the shoes of the wearer to provide an air-cushioning and cooling effect heretofore unrealized.

2. Background Art

Shoe inserts of varying types have been previously known for increasing the comfort of the feet of the wearer. Varying types of foam and compressionable materials have been utilized within the shoe but all are believed to have suffered deficiencies and not been fully satisfactory for their intended purpose. A primary problem of prior art shoe inserts is believed to have been that the various compression materials were able to only absorb a minimal amount of shock since a sufficient amount of material to fully absorb the shock of a foot contacting a support surface would be too voluminous to comfortably fit within a standard shoe.

In order to meet the long-felt need for an effective and comfortable shoe insert, applicant developed the shoe insert described and claimed in his U.S. Pat. No. 4,336,661 entitled "Shoe Insert" and issued June 29, 1982. The patented shoe insert utilizes vacuum action with a single bivalve hole located in the arch area and incorporated into the relatively thin shoe insert to provide shock absorption capabilities of a thicker compression material. Further, the shoe insert provides a ventilation effect to the foot of the wearer due to the egress and ingress of air through the single bivalve hole of the insert when the insert is in use. However, neither applicant's patented insert or any other prior art insert is believed to be as cool and comfortable to the wearer as the improved insert of the present invention.

DISCLOSURE OF INVENTION

The instant invention provides for an improved shoe insert utilizing an improved vacuum action system with multiple bivalve air pressure release holes for ventilation and shock absorption. The improved system comprises a plurality of relatively smaller diameter holes distributed in the heel and ball of the foot portion of the insert in addition to the hole previously provided in the arch area of the insert. A printed pattern is also provided on the top surface of the shoe insert to provide a novel appearance to the shoe insert.

It is a general object of this invention to provide an improved insert which releases air as one uses shoes into which they are inserted. As weight is exerted thereon, air is released by the insert, and when the weight is withdrawn, air is absorbed by the insert so that the entire process is accomplished readily and is most comfortable to the wearer.

It is an object of this invention to provide for an improved insert for shoes which utilizes increased air circulation and more uniform distribution thereof so as to cushion, ventilate and cool the feet of a wearer whether standing, walking or jogging and to provide softness as well as comfort.

It is a further object of this invention to provide air pumping and circulating shoe inserts which are comprised of an envelope of a non-porous material, insofar as air is concerned, which is provided with a single hole through the non-porous material in the arch area and a plurality of additional relatively smaller diameter holes in the heel and ball of the foot portions so that when walking, there is a pumping action of air in two stages; first, when the heel contacts a support surface, and second, when the ball of the foot contacts the support surface so that air is cyclically and continually expelled and circulated within the shoe between the foot and the insert. The air cools and ventilates the foot and the controlled egress and ingress thereof from and into the insert facilitates the cushioning effect to the foot of the wearer.

In accordance with these and other objects which will become apparent hereinafter, the instant invention will now be described with reference to the accompanying drawings in which:

BEST MODE FOR CARRYING OUT THE INVENTION

Figure 1:
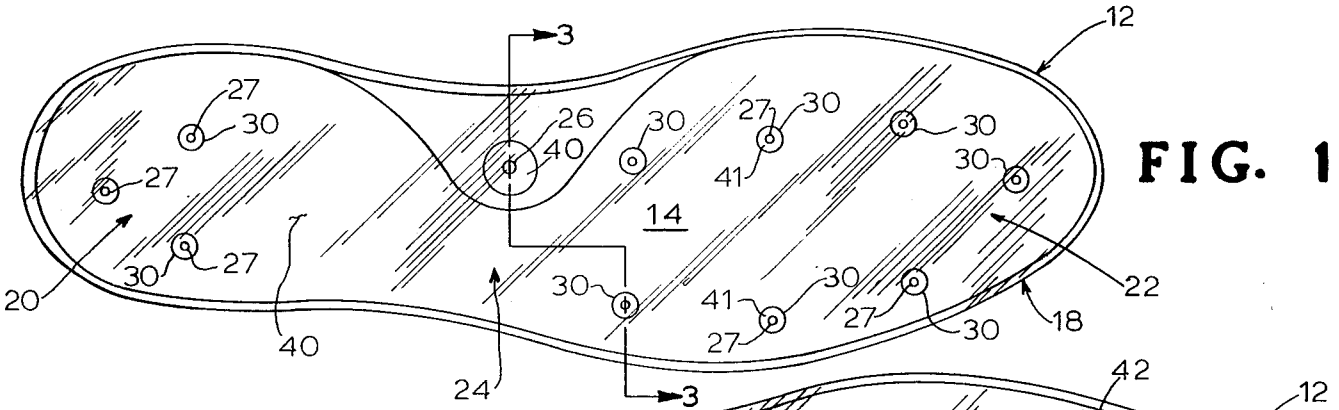
FIG. 1 is a top plan view of the improved insert of the instant invention.
Figure 2:
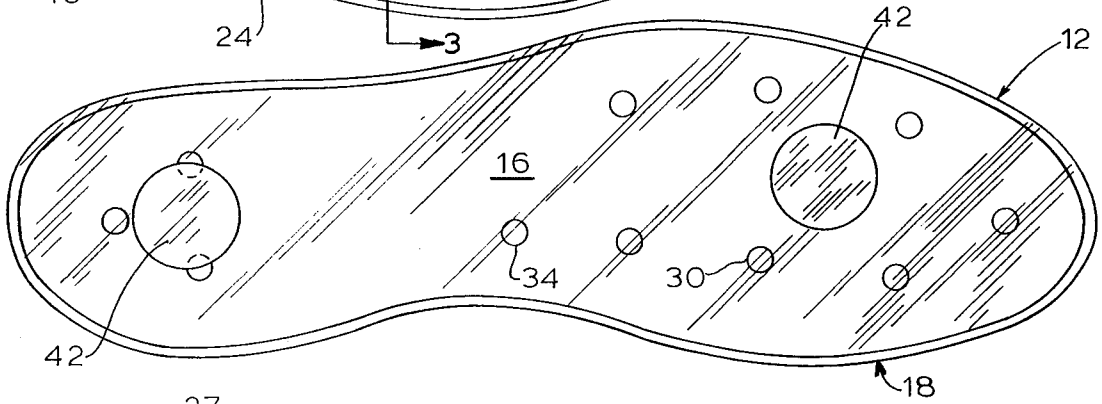
FIG. 2 is a bottom plan view of the improved insert of the instant invention.

Referring to the drawings wherein like reference characters designate like or corresponding parts throughout the several views and referring particularly now to FIG. 1, there is shown a shoe insert which is comprised of an envelope 12 of material which is impervious to air, such as a sheet of flexible, pliable plastic. The envelope generally traces the outline of the human foot and comprises top wall or surface 14, bottom wall or surface 16 (FIG. 2) and side wall or surface 18.

Figure 3:
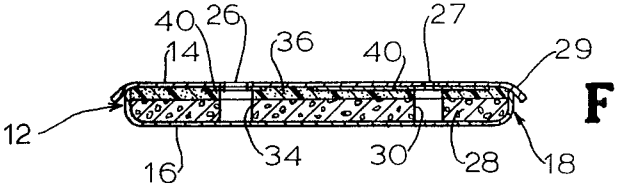
FIG. 3 is an enlarged view in cross section taken on the plane indicated by the line 3—3 in FIG. 1 and with the thickness of the printed pattern exaggerated for purpose of illustration.

For convenience and further reference, the insert may be considered as having a heel zone 20, a forward zone 22, and an intermediate zone 24. It can be seen that there is a hole 26 through intermediate zone 24 of top wall 14 of about one-quarter inch diameter spaced from the side edges and preferably along a longitudinal centerline of the insert. Additional holes 27 are provided in heel zone 20 and forward zone 22 of top wall 14. Holes 27 are of smaller diameter than hole 26 and normally would be about one-sixty fourth inch in diameter. Within envelope 12, a pad 28 (FIG. 3) of cushioning material is provided. The pad 28 is sized to nestle between the upper and lower walls of the envelope and generally spanning the interior thereof. Side wall 18 is comprised of a downwardly turned ridge 29 extending around the entire periphery of the envelope and formed by heat sealing of the periphery of the upper wall to the periphery of the lower wall of envelope 12. Pad 28 within envelope 12 is comprised of a yieldable porous foam material and preferably has a plurality of holes 30 therein arranged in a predetermined pattern and extending through pad 28 but not through envelope 12 and providing plural holes 30 positioned vertically beneath top wall holes 27. A hole 34 (FIG. 2) in pad 28 is also provided vertically beneath hole 26 in top wall 14 of envelope 12. Holes 30 and 34 in pad 28 are preferably about one-quarter inch in diameter. In the preferred embodiment, between pad 28 and upper wall 14 of envelope 12, a layer 36 of about one-sixteenth to one-eighth inch thickness of rubbery-type material is provided, preferably a synthetic rubber sheet, which is adhesively secured to the top surface of pad 28. Pad 28 is preferably impregnated with very fine charcoal for better humidity absorption and rubber layer 36 has holes therein which vertically register with the aforementioned holes in pad 28.

Upper wall 14 and lower wall 16 of envelope 12 are heat-sealed together and are preferably constructed of transparent polyethylene plastic sheet material, such as vinyl. The upper vinyl wall is most desirably 0.0025 inches thick and the bottom vinyl wall 0.0030 inches thick. Further provided for a novel and pleasing appearance is printed pattern 40 (FIGS. 1 and 3) adhered to the inside surface of top wall 14 of envelope 12. Preferably, printed pattern 40 is an opaque aluminum paint which is selectively silk screen printed to the inside of top wall 14 of envelope 12 (FIG. 3) in an aesthetically pleasing pattern surrounding top surface holes 26 and 27. Printed pattern 40 defines a plurality of non-painted circular spots 41 therein without paint and of predetermined location and superimposed position over each of the heel zone and forward zone holes 30 in pad 28 and surrounding each of the corresponding top wall holes 27. Unpainted spots 41 are also preferably of one-quarter inch diameter as are the holes in pad 28. Body heat tends to be dissipated by the superior controlled air circulation system of the shoe insert which thereby provides outstanding wearer comfort.

Pattern 40 printed on the inside of top wall 14 of envelope 12 is printed in such a configuration, as previously noted, to be pleasing to the eye (as best seen in FIG. 1). It has been found advantageous to print pattern 40 inside top wall 14 since outside printing tends to wear due to abrasion and the necessity for an aluminum foil-type sheet within envelope 12 is obviated. The enhanced aesthetics of aluminum colored pattern 40 printed on the inside of transparent vinyl upper wall 14 and contrasting with the dark color of foam pad 28 therebeneath serves to further differentiate the present invention from previous shoe inserts known to applicant. The appearance is intended to render an astronautical appearance to the shoe insert of the present invention. Also, in the preferred embodiment of the invention, double-sided adhesive spots 42 (FIG. 2) are provided on bottom wall 16 of envelope 12 in order to better adhere the shoe insert of the present invention to the inside sole of the shoe of the wearer. Adhesive spots 42 tend to prevent relative movement of the shoe insert within the shoe of the wearer.

In use, when the inserts are within a shoe, the wearer will place his heel down when walking which forces air through pad 28 and into the front portion of envelope 12 so as to release a portion of the air through central hole 26 and front zone holes 27 of top wall 14 of envelope 12 and, as the rolling action of the walking movement of the foot takes place, there will be pressure applied to the front portion of envelope 12 which will again cause a release of air from central hole 26 and heel zone holes 27 of envelope 12. Air will return to the insert through the same holes when the pressure is released therefrom only momentarily. A wearer walking with shoes fitted with the improved insert will find that there is increased circulation of air within the shoe making the wearer much more comfortable and providing a softer and more enjoyable walk. The improved air circulation provided by hole 26 and holes 27 also serves to dissipate body heat generated by the confined foot. The overall height of the insert is preferably only three-sixteenths of an inch but should not be over one-half of an inch or less than one-sixteenth of an inch.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent articles.

What is claimed is:

1. A shoe insert, comprising:

(a) an envelope of air impervious transparent thin plastic film material, said envelope, as seen in plan, tracing the outline of a human foot with a heel zone, a forward zone and an intermediate zone;

(b) said envelope having upper and lower walls and a side wall joining said upper and lower walls;

(c) said upper wall having in said intermediate zone a first hole therethrough of a first diameter and in said heel and forward zones second plural holes of a second diameter less than said first diameter;

(d) an opaque pattern printed on the inside surface of said upper wall and defining with unprinted portions thereof the location of said first and second holes; and (e) a flat pad of cushioning foam material in said envelope confined between said upper, lower and side walls, said pad of cushioning foam material having in registry with said first hole in said upper wall a third hole passing therethrough and in registry with said second plural holes fourth plural holes passing therethrough, whereby as the wearer of said shoe insert walks and asserts pressure on said heel zone air is forced into said forward zone and expelled through said first hole in said intermediate zone and said second plural holes in said forward zone followed as said wearer asserts pressure on said forward zone by air being forced into said heel zone and expelled through said first holes in said intermediate zone and said second plural holes in said heel zone.

2. A shoe insert as claimed in claim 1 wherein:

(a) said printed pattern comprises an opaque aluminum colored printed pattern; and (b) said unprinted portions of said printed pattern comprise unprinted circular spaces coinciding in location with the location of said holes.

* * * * *